US005523123A

United States Patent [19]

Ginzburg et al.

[11] Patent Number: 5,523,123

[45] Date of Patent: Jun. 4, 1996

[54] OIL APPLICATOR AND METHOD FOR APPLYING A FILM OF OIL TO A METAL STRIP

[75] Inventors: Vladimir B. Ginzburg, Pittsburgh; Edward R. Schaming, Evans City, both of Pa.

[73] Assignees: International Rolling Mill Consultants, Inc.; Danieli United, Inc., both of Pittsburgh, Pa.

[21] Appl. No.: 275,772

[22] Filed: Jul. 15, 1994

[51] Int. Cl.[6] ..... B05D 1/28; B05C 1/08

[52] U.S. Cl. ..... 427/295; 427/428; 427/429; 118/50; 118/244; 118/264; 492/17; 492/28

[58] Field of Search ..... 427/295, 428, 427/429; 118/50, 244, 264; 492/17, 28

[56] References Cited

U.S. PATENT DOCUMENTS

| | | | |
|---|---|---|---|
| 2,272,368 | 2/1942 | Duffy | 80/35 |
| 2,870,737 | 1/1959 | Byrnes | 118/227 |
| 3,416,489 | 12/1968 | Hoffmann | 118/227 |
| 3,710,469 | 1/1973 | Kitazawa | 29/125 |
| 4,653,303 | 3/1987 | Richard | 72/236 |

*Primary Examiner*—Shrive Beck
*Assistant Examiner*—Katherine A. Bareford
*Attorney, Agent, or Firm*—Armstrong, Westerman, Hattori, McLeland & Naughton

[57] ABSTRACT

An oil applicator for applying a film of oil to a strip of metal has a hollow tubular shaft having a porous, oil absorbent sleeve, with oil sprays spraying oil onto the surface of the sleeve and a vacuum drawn through the hollow of the shaft to draw excess oil through apertures in the shaft wall for collection in a housing. A casing is provided that contains the applicator roll and a slot in the wall of the casing communicates with a duct through which a second vacuum is drawn which removes excess oil that may be applied to the strip of metal and collects the same in a second housing.

15 Claims, 1 Drawing Sheet

OIL APPLICATOR AND METHOD FOR APPLYING A FILM OF OIL TO A METAL STRIP

BACKGROUND OF THE INVENTION

The present invention relates to an applicator and method for applying a film of oil to a strip of metal.

In processing of metal strips, such as in the cold rolling of a strip of metal, an oil film is applied to the strip to protect the surface thereof against corrosion and rust. Various systems have been proposed for applying such a film of oil which include systems that spray a film of oil on the strip of metal or the use of transfer rolls that are coated with oil that transfer the oil to the strip of metal by contact of the transfer roll with the strip of metal moving past the transfer roll. Problems exist in connection with both such systems in assuring that the film of oil is applied uniformly to the strip of metal and that any excess oil, which may be applied to the strip of metal, is contained and collected so as to prevent splashing of oil on surrounding equipment or personnel.

Examples of equipment previously proposed for applying a film of oil to a sheet or strip of metal are described in U.S. Pat. Nos. 2,870,737, 3,416,489 and 3,710,469, the contents of said patents incorporated by reference herein. U.S. Pat. No. 2,870,737 describes the use of hollow rollers with felt-like washers, or other porous substance, on the periphery to apply oil to a sheet passing between two opposed rollers. Oil is fed to a roller internal hollow chamber and is forced through a spongeous cover on the roller to be released by contact with the metal sheet or strip. U.S. Pat. No. 3,416,489, on the other hand, shows application of oil to an application roller by spraying oil onto a felt cover on the roller and transferring the applied oil to a sheet of material passing in contact with the felt cover. U.S. Pat. No. 3,710,469 shows an oiling roller that has a hollow arbor with spiral grooves in the surface and a non-woven fibrous elastic porous pad over the arbor, where oil is charged to the hollow arbor and passes outwardly through the pad for transfer to a metal sheet passing in contact with the pad.

It is an object of the present invention to provide an apparatus and method for applying a film of oil to a strip of metal whereby excess oil which may be applied to a spongy applicator roller is removed and collected so as to prevent spreading or splashing of the oil due to centrifugal forces.

It is another object of the present invention to provide an apparatus and method for applying a film of oil to a strip of metal such that any excess oil which may be applied to the strip is removed and collected.

SUMMARY OF THE INVENTION

The present invention is an oil applicator and a method for use in applying a thin film of oil uniformly and evenly over a strip of metal, such as in a cold roll mill for metal. The oil applicator is arranged to contact a strip of metal passing by the applicator and has an applicator roll in the form of a rotatably mounted hollow tubular shaft with a porous, oil-absorbent sleeve mounted on the shaft and apertures in the wall of the shaft such that the hollow of the shaft communicates with the porous, oil-absorbent sleeve.

A casing is provided, which is superimposed, in spaced relationship, over the applicator roll, the casing having an open channel formed therein through which a portion of the porous, oil-absorbent sleeve extends and contacts a strip of metal passing by the outer surface of the roll so as to apply a film of oil to the strip surface. An oil manifold is secured to the casing and oil fed to the manifold is directed through nozzles and through an opening in the casing onto the outer surface of the porous, oil-absorbent sleeve to coat the sleeve and provide oil for transfer to the metal strip. A vacuum source is provided which draws a vacuum through the hollow of the tubular shaft and pulls excess oil that collects in the porous, oil-absorbent sleeve through the apertures in the sleeve wall and into the hollow for discharge from the oil applicator.

A slot may be formed in the casing at a location opposite the oil sprays and a duct encloses the slot. The duct is connected to a second vacuum source such that excess oil which may have been applied to the metal strip is drawn through the slot and into the duct for discharge.

The present method provides for applying a film of oil to a strip of metal by directing a spray of oil onto a porous, oil-absorbent sleeve carried by a hollow tubular shaft, and drawing a vacuum through the hollow of the shaft to remove excess oil from the sleeve, removing the excess oil from the hollow of the shaft and collecting the same. The outer surface of the porous, oil-absorbent sleeve contacts the strip of metal passing by to transfer oil to the strip of metal. In a most preferred method, a casing is provided about a major portion of the porous, oil-absorbent sleeve and a second vacuum is drawn through a slot in the casing so as to remove any excess oil applied to the strip of metal.

DESCRIPTION OF THE DRAWINGS

The invention will be more fully understood, and further objects and advantages will become more readily apparent, in the following description of a preferred embodiment of the present invention illustrated in the accompanying drawings, in which.

DETAILED DESCRIPTION

The present oil applicator and method provide for the application of oil as a thin film to a strip of metal such that excess oil which may be applied to an applicator roll is collected and such that any excess oil that may be applied to the strip of metal is also collected and thus maintains a clean environment about the applicator and a uniform oil application to the strip of metal.

Figure 1:
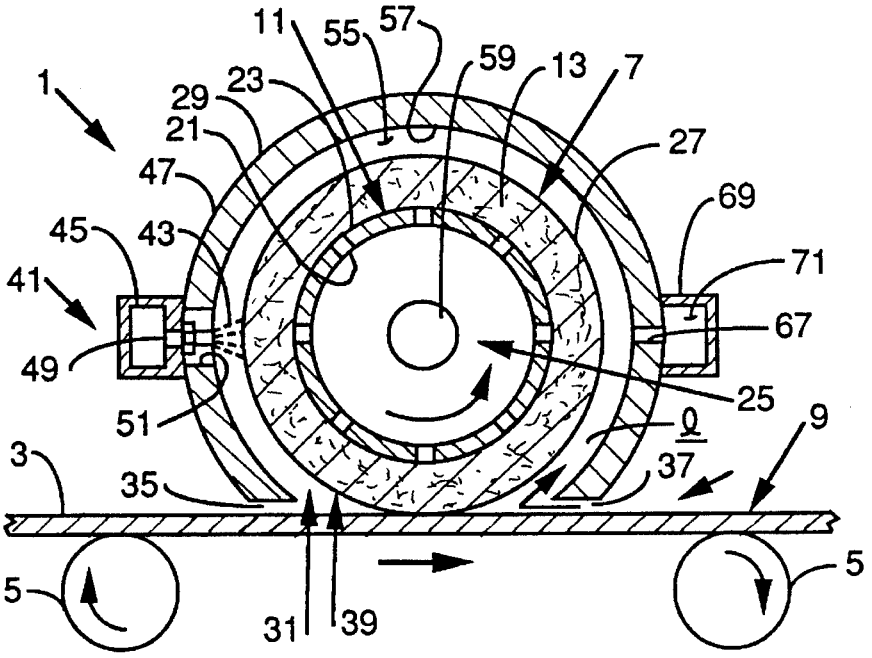
FIG. 1 is a cross-sectional view through an oil applicator of the present invention.
Figure 2:
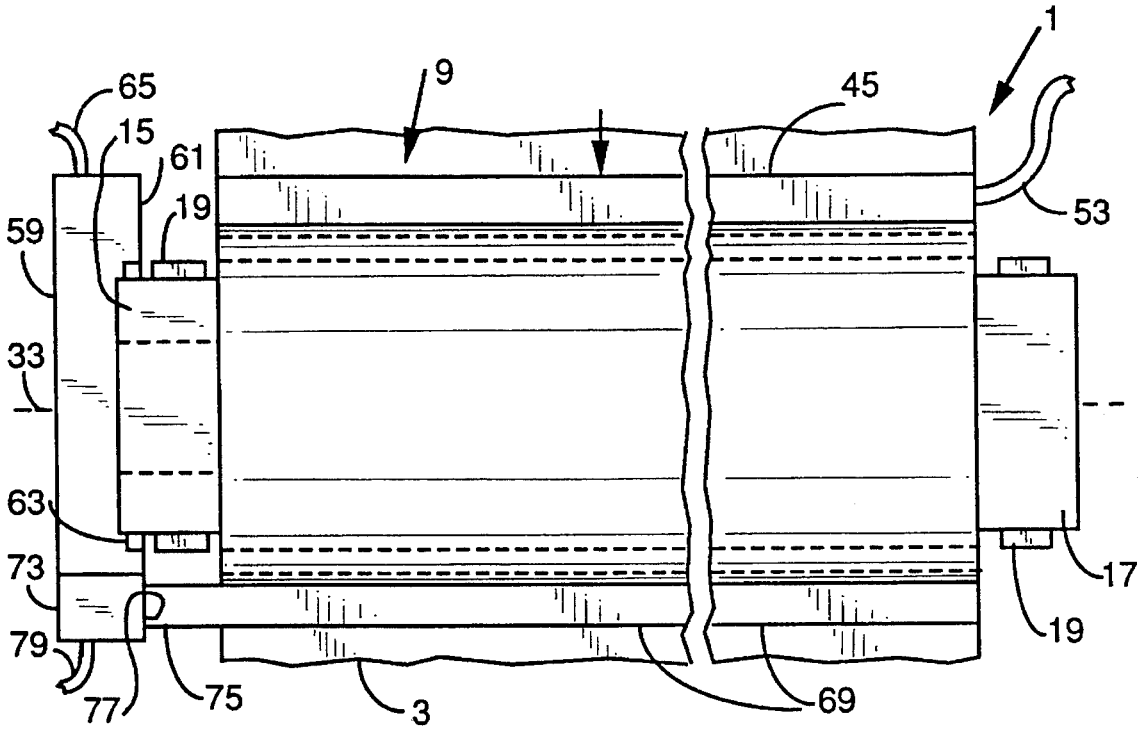
FIG. 2 is a plan view of the oil applicator illustrated in FIG. 1.

Referring now to the drawings, a preferred embodiment of the oil applicator 1 is illustrated showing application of oil to a strip of metal 3, which is passed in the direction of the arrow shown in FIG. 1 by means of table rolls 5. An applicator roll 7 is used to apply a thin film of oil to the surface 9 of the strip of metal 3, the applicator roll 7 comprising a rotatably mounted hollow tubular shaft 11 having a porous, oil-absorbent sleeve 13 mounted thereon. The ends 15 and 17 of the hollow tubular shaft 11 are supported for rotation by bearings 19 and the hollow tubular shaft 11 is free-wheeling and rotated by contact of the porous, oil-absorbent sleeve 13 with the moving metal strip 3. A plurality of apertures 21 are formed through the wall 23 of the hollow tubular shaft 11, which apertures 21 communicate between the hollow 25 of the shaft 11 and the porous, oil-absorbent sleeve 13. The porous, oil-absorbent sleeve 13, which has an outer surface 27, may be a series of rings of a nonwoven fiber or spongy material such as a sponge rubber, or a synthetic resin foam, that will absorb oil and be resistant to attack by the oil, such as a plurality of felt washers, pressed together transversely of the shaft periphery, on the hollow tubular shaft 11.

A casing 29 is superimposed in spaced relationship over the applicator roll 7 and surrounds the outer surface 27 of the applicator roll 7, except for a portion thereof that is adjacent the metal strip 3, where an open axial channel 31 is formed along the axis 33 of the applicator roll 7, the casing having confronting ends 35 and 37 that are spaced from but closely adjacent the upper surface 9 of the strip of metal 3. The casing 29 is arranged such that a portion 39 of the outer surface 27 of the porous, oil-absorbent sleeve 13 extends outwardly through the open axial channel 31 and contacts the strip of metal 3 passed across the open axial channel 31 by table rolls 5.

On the upstream side of the casing 29, according to the direction of movement of the strip of metal, is provided a means 41 for directing a spray of oil 43 through the casing 29 and onto the outer surface 27 of the porous, oil-absorbent sleeve 13. A preferred means 41 of directing a spray of oil is illustrated as an oil manifold 45 secured to the outer surface 47 of the casing 29, with spray nozzles 49 which extend through bores 51 in the casing 29. A hose 53 directs oil from a source (not shown) into the oil manifold 45. The casing 29 is preferably cylindrical in shape so as to provide a substantially uniform radial gap 55 between the outer surface 27 of the porous, oil-absorbent sleeve 7 and the inner surface 57 of the casing 29.

A housing 59 is provided at one end 15 of the applicator roll 7 having a wall 61 through which an end 15 of the hollow tubular shaft 11 extends, with a seal 63 sealing the rotatable shaft with the wall 61, such that the hollow 25 of the hollow tubular shaft 13 is in sealed fluid communication with the housing 59. A vacuum source (not shown) is connected to the housing 59 through vacuum line 65 and provides a vacuum therein, as well as in the hollow 25 of the hollow tubular shaft 13.

In a most preferred oil applicator of the present invention, a slot 67 is formed in the casing 29, at the downstream side of the casing, opposite the means 41 for directing a spray of oil 43 onto the outer surface 27 of the porous, oil-absorbent sleeve 13. A duct 69 is secured to the casing 29 enclosing the slot 67, the duct forming a chamber 71 which communicates with the slot 67. A second housing 73 is provided at the end 15 of the applicator roll 7, which communicates with one end 75 of the duct 69 through a wall 77 of the housing, such that chamber 71 formed by the duct 69 is in fluid communication with the second housing 73. A vacuum source (not shown) is connected through a second vacuum line 79 to the second housing 73 and provides a vacuum therein, as well as in the chamber 71 formed by the duct 69.

In accordance with the present method, a spray of oil 43 is directed onto the outer surface 27 of a porous, oil-absorbent sleeve 13 mounted on a rotatably mounted hollow tubular shaft 11. With the hollow 25 of the shaft in fluid communication with the porous, oil-absorbent sleeve 13 by means of apertures 41 formed in the wall 23, a vacuum is drawn through the hollow 25 of the tubular shaft 11 which draws excess oil from the porous, oil-absorbent sleeve 13 into the hollow 25. The excess oil drawn into the hollow 25 is removed therefrom by the vacuum and collected in housing 59. The outer surface 27 of the porous, oil absorbent sleeve is contacted with the strip of metal 3 passing across the open axial channel 31 to transfer a film of oil to the surface 9 of the strip of metal 3. In order to further assure that the film of oil is not applied in excess to the strip of metal 3, the casing 29 is provided about the porous, oil absorbent sleeve 13, except where the outer surface 27 thereof contacts the strip of metal 3 and a second vacuum is drawn through the casing 29, through slot 67 and into duct 69, and excess oil on the surface 9 is removed and collected in housing 73.

As shown in FIG. 1, when excess oil e is applied to the surface 9 of the strip of metal 3 from the applicator roll 7, the vacuum drawn through chamber 71 and slot 67 will draw outside air between the end 37 of the casing 29 and the strip of metal 3, as shown by the arrow, which air will collect droplets of oil and carry the same through slot 67 into duct 69 for transfer to housing 73.

The degree of vacuum that is drawn in the hollow 25 of the hollow tubular shaft 11 to draw excess oil into the hollow 25 and subsequently into housing 59 should be that comparable to a pressure change of between about 4–8 inches of water column (about 0.01–0.02 atmosphere), most preferably about 5 inches of water. Likewise, when used, the degree of vacuum that is drawn in the duct 69 to draw excess oil from the surface 9 of the strip of metal 3 and subsequently into housing 73 should be between about 4– 8 inches of water, most preferably about 5 inches of water.

What is claimed is:

1. A method of applying a film of oil to a sheet of metal comprising:

directing a spray of oil onto the outer surface of a porous, oil-absorbent sleeve mounted on a rotatably mounted hollow tubular shaft, the hollow of said shaft being in fluid communication with said porous, oil-absorbent sleeve;

drawing a vacuum through the hollow of said tubular shaft so as to remove excess oil from said porous, oil-absorbent sleeve into said hollow;

removing said excess oil from the hollow of said tubular shaft by said vacuum and collecting said excess oil; and contacting said outer surface of said porous, oil-absorbent sleeve with a strip of metal pressing in contact therewith.

2. The method as defined in claim 1 including providing a casing about said porous, oil absorbent sleeve except where the outer surface thereof contacts said strip of metal and drawing a second vacuum through said casing and removing excess oil from said strip of metal by said second vacuum and collecting said strip excess oil.

3. The method as defined as claim 2 wherein said vacuum drawn through said casing provides a reduced pressure of between about 4 and 8 inches of water.

4. The method as defined in claim 1 wherein said vacuum drawn through the hollow of said tubular sleeve provides a reduced pressure therein of between about 4 and 8 inches of water.

5. An oil applicator, adapted for applying a film of oil onto a strip of metal passing by the applicator, comprising:

an applicator roll arranged to contact said strip of metal, said applicator roll comprising a rotatably mounted hollow tubular shaft having a wall with apertures formed therein, and a porous, oil-absorbent sleeve mounted on said hollow tubular shaft and having an outer surface;

a casing superimposed in spaced relationship over said applicator roll having an open channel through which the outer surface of said porous, oil-absorbent sleeve contacts said strip of metal to apply a film of oil thereto;

means for directing a spray of oil through said casing onto the outer surface of said porous, oil-absorbent sleeve; and means for providing a vacuum within said hollow tubular shaft so as to draw excess oil sprayed onto said porous, oil-absorbent sleeve through the apertures formed in the wall of said hollow tubular shaft into the hollow thereof for discharge from said oil applicator.

6. The oil applicator as defined in claim 5 wherein said means for directing a spray of oil through said casing includes an oil manifold, connected to a source of oil, and spray nozzles arranged to direct oil from said manifold through an opening in said casing.

7. The oil applicator as defined in claim 5 wherein said casing is cylindrical in shape and provides a substantially uniform radial gap between the outer surface of said sleeve and an inner surface of said casing.

8. The oil applicator as defined in claim 5 wherein said means for providing a vacuum within said hollow tubular shaft is sufficient to provide a reduced pressure therein of between about 4 and 8 inches of water.

9. The oil applicator as defined in claim 5 wherein said casing has a slot therein, on the side thereof opposite said means for directing a spray of oil, and including a duct on said casing forming a chamber communicating with said slot and means for providing a vacuum within said chamber so as to remove excess oil applied to said sheet therefrom.

10. The oil applicator as defined in claim 9 wherein said means for providing a vacuum within said chamber is sufficient to provide a reduced pressure therein of between about 4 and 8 inches of water.

11. An oil applicator, adapted for applying a film of oil onto a strip of metal passing by the applicator, comprising:

an applicator roll arranged to contact said strip of metal, said applicator roll comprising a rotatably mounted hollow tubular shaft having a wall with apertures formed therein, and a porous, oil-absorbent sleeve mounted on said hollow tubular shaft and having an outer surface;

a casing superimposed in spaced relationship over said applicator roll having an open channel through which the outer surface of said porous, oil-absorbent sleeve contacts said strip of metal to apply a film of oil thereto;

means for directing a spray of oil through said casing onto the outer surface of said porous, oil-absorbent sleeve;

said casing having a slot formed therein, opposite said means for directing a spray of oil;

a duct on said casing forming a chamber communicating with said slot;

means for providing a vacuum within said hollow tubular shaft so as to draw excess oil sprayed onto said porous, oil-absorbent sleeve through the apertures formed in the wall of said hollow tubular shaft into the hollow thereof for discharge from said oil applicator; and means for providing a vacuum within said chamber of said duct so as to remove excess oil applied to said sheet therefrom.

12. The oil applicator as defined in claim 11 wherein said means for directing a spray of oil through said casing includes an oil manifold, connected to a source of oil, and spray nozzles arranged to direct oil from said manifold through an opening in said casing.

13. The oil applicator as defined in claim 11 wherein said casing is cylindrical in shape and provides a substantially uniform radial gap between the outer surface of said sleeve and an inner surface of said casing.

14. The oil applicator as defined in claim 11 wherein said means for providing a vacuum within said hollow tubular shaft is sufficient to provide a reduced pressure therein of between about 4 and 8 inches of water.

15. The oil applicator as defined in claim 11 wherein said means for providing a vacuum within said chamber is sufficient to provide a reduced pressure therein of between about 4 and 8 inches of water.

* * * * *